US011034117B2

(12) United States Patent
Virgen, III

(10) Patent No.: US 11,034,117 B2
(45) Date of Patent: Jun. 15, 2021

(54) RELEASABLE PUNCH DAMPENER

(71) Applicant: Raymond A Virgen, III, Washington, MO (US)

(72) Inventor: Raymond A Virgen, III, Washington, MO (US)

( * ) Notice: Subject to any disclaimer, the term of this patent is extended or adjusted under 35 U.S.C. 154(b) by 134 days.

(21) Appl. No.: 16/402,176

(22) Filed: May 2, 2019

(65) Prior Publication Data

US 2019/0337256 A1 Nov. 7, 2019

Related U.S. Application Data

(60) Provisional application No. 62/667,069, filed on May 4, 2018.

(51) Int. Cl.

| | |
|---|---|
| ***B30B 15/28*** | (2006.01) |
| ***B30B 11/00*** | (2006.01) |
| ***B30B 11/08*** | (2006.01) |

(52) U.S. Cl.

CPC ..... *B30B 15/287* (2013.01); *B30B 11/008* (2013.01); *B30B 15/288* (2013.01); *B30B 11/08* (2013.01)

(58) Field of Classification Search

CPC ... B30B 15/287; B30B 15/288; B30B 11/005; B30B 11/08

See application file for complete search history.

(56) References Cited

U.S. PATENT DOCUMENTS

| | | | | |
|---|---|---|---|---|
| 4,688,459 A * | 8/1987 | Osborn | B21D 28/36 279/97 |
| 6,050,798 A * | 4/2000 | Konig | B30B 11/08 425/214 |
| 6,463,839 B2 * | 10/2002 | Ohtsuka | B21D 19/08 83/686 |
| 2002/0007714 A1 * | 1/2002 | Ohtsuka | B21D 45/08 83/698.31 |

* cited by examiner

*Primary Examiner* — Adam J Eiseman
*Assistant Examiner* — P Derek Pressley
(74) *Attorney, Agent, or Firm* — Linda L. Lewis

(57) ABSTRACT

A rotary tablet press has a rotating mold table and top and bottom punches, which can move reciprocally in punch guides, coaxially with the molds. The reciprocating motion of at least the bottom punches is cam-controlled and these punches are acted upon by a releasable punch dampener to prevent an overshoot of their movement and to ensure an action which is as free from wear. It is as maintenance-free as possible whilst maintaining constant damping of the bottom punches. The releasable punch dampener releases with one motion and has a linear release shaft with a release surface and a dampening surface.

20 Claims, 2 Drawing Sheets

RELEASABLE PUNCH DAMPENER

CROSS-REFERENCE TO RELATED APPLICATIONS

This application claims the benefit of provisional patent application 62/667,069 filed May 4, 2018 which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

This invention relates to a releasable punch dampener device for use in a rotary tablet press having a rotating turret and top and bottom punches. The punches move in punch guides, coaxially with the molds and with the execution of a stroke. The bottom punches are cam-controlled for the execution of their stroke and return stroke and are acted upon by the releasable punch dampener device to prevent an overshoot of their stroke or return stroke movement.

Background of the Invention

When tablets are pressed in rotary tablet presses, the weight of the tablets is determined by the filling volume of the powder introduced into the molds. It is important that the molds, which are closed at the bottom by the bottom punches, always receive the same powder volume before pressing. The bottom punches, which are raised and lowered by a plurality of control cams during the rotation of the turret, are subjected to considerable forces of acceleration during these vertical movements. Since it has been practically impossible to achieve cooperation between the punches and the control cams, it is necessary to use a damping element with the punches in order to prevent an overshoot of their stroke movement, namely to prevent lift-off of the punch from the control cam, which would otherwise result in inaccuracies in filling and thus in the weight of the tablets to be pressed.

In the past, brake pins have been employed as damping elements. These are inserted in a transverse bore leading into the punch and are pressed against the punch by a pressure spring via an adjustable pressure plate. The pin exerts a force on the punch which is transverse to the direction of movement of the punch, and the frictional force is increased between the punch guide and the punch. It is possible to use a spring pressure piece, such as those which are frequently used for snap-in locking devices. This spring pressure piece is placed in a transverse bore leading into the punch guide, and its spring-loaded pressure head presses against the punch, so that the punch is subjected to damping during its vertical movement.

These known solutions have the disadvantage that it is very difficult to adjust the pre-stress of the spring and the transverse force which is exerted on the punch, in order to prevent overshoot of the punch during its stroke movement, and to keep the frictional forces between the punch guide and the punch shank as low as possible. The spring stress setting seldom holds due to vibration of the machine. Consequently, it is necessary to adjust these mechanical damping elements frequently. On large tablet presses which often comprise more than 50 molds and bottom punches, adjusting so many damping elements is time-consuming. Moreover, these damping elements have the disadvantage that they must be removed completely to dismantle the punches, since the brake pin which presses against the punch can engage in an undercut on the punch, so that the punch cannot be withdrawn.

In order to reduce the time necessary for the removal, installation and adjustment of the large number of damping elements described above, it has also been proposed that an encircling groove for the bottom punches be provided on the periphery of the turret peripherally intersecting the punch guides. The punches would project laterally by a slight extent beyond the base of the groove. A tensionable brake band, which is fixed or loosened by means of a simple band clamp, is disposed in the groove, and its inner peripheral face presses against the punch and dampens the movement of the punch. This design has the advantage that it can rapidly be removed for the dismantling of the punches and can be re-installed rapidly after they have been installed. However, it does not ensure that the requisite frictional or damping force, which should be as constant as possible, is exerted on each punch.

U.S. Pat. No. 6,050,798 discloses the use of magnets to dampen the motion of lower punches. Such an approach fails to provide consistent and effective dampening.

SUMMARY OF THE INVENTION

The present invention provides a rotary tablet press with a releasable punch dampener for dampening the cam-controlled punches. The releasable punch dampener is releasable without tools and with one motion. In a preferred embodiment, the releasable punch dampener has a linear release shaft having a proximate end and a remote end. On the proximate end is a release device that is used to move the shaft from a first position to a second position. On the shaft is a release surface. Adjacent to the release surface is a dampening surface. On the release shaft is a spring engaging surface with a spring mounted therein providing axial tension. The spring is biased to engage the dampening surface with a punch.

The releasable punch dampener has an engaged position and a released position. In the engaged position, the spring acts on the spring engaging surface to cause the dampening surface to engage with and dampen the punch. This position is shown in FIG. 1. The spring is biased to the engaged position. In the released position, the release device is engaged causing the releasable punch dampener to move to the unbiased position. In the released position, the dampening surface is moved from the punch and the release surface is proximate the punch, but not touching the punch. In the released position, the punch is released from the releasable punch dampener.

The releasable punch dampener of the present invention provides advantages over prior art punch dampeners. When a punch is installed and removed, the associated punch dampener does not have to be removed, since when the release device is engaged, it does not project into the punch guide and thus cannot impede installation or removal. Further, no special modifications of the punch shaft are needed with this punch dampener.

Other features and advantages of the invention follow from the description given below and from the drawings, wherein a preferred embodiment of the invention is illustrated in more detail by way of example.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE PREFERRED EMBODIMENTS

Figure 1:
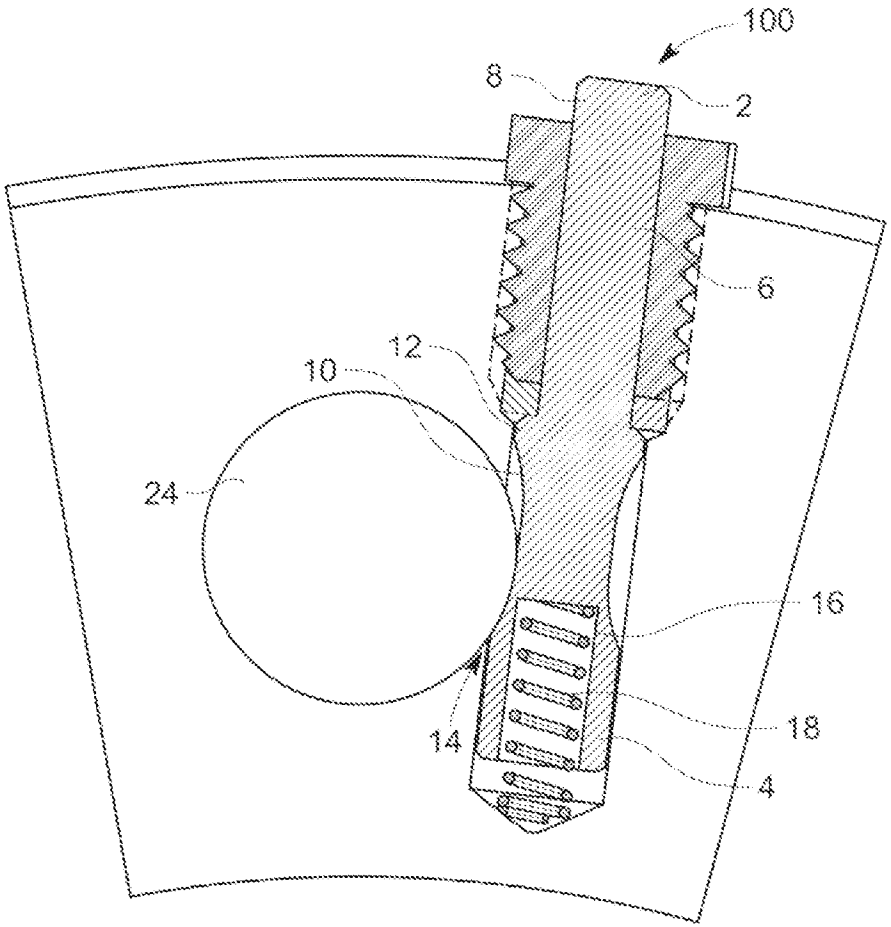
FIG. 1 is a horizontal cutaway view of the releasable punch dampener in the engaged position mounted in the turret of a rotary tablet press.
Figure 2:
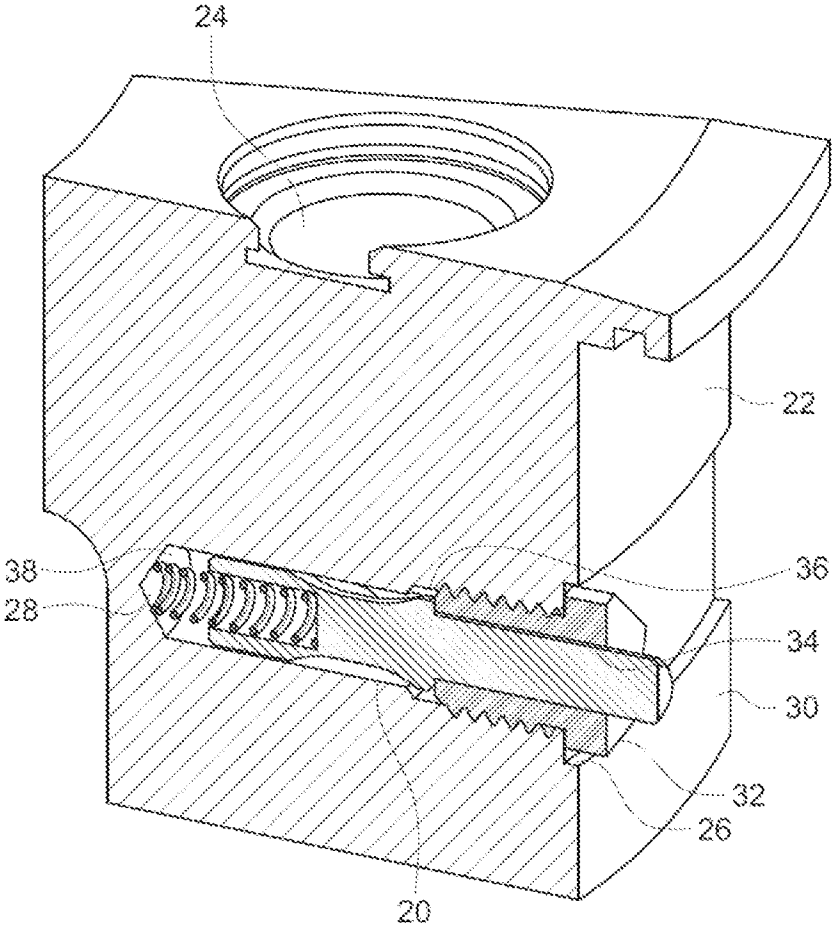
FIG. 2 is a vertical cutaway view of the releasable punch dampener in the engaged position mounted in the turret of a rotary tablet press.

The following description of the preferred embodiment(s) is merely exemplary in nature and is in no way intended to limit the invention, its application, or uses. In a preferred embodiment, as shown in FIGS. 1 and 2, the releasable punch dampener 100 has a release shaft 6 having a release shaft proximate end 2 and a release shaft remote end 4. On the proximate end is a release device 8. The release device 8 shown in FIG. 1 is a depressible shaft. However, the release device can a screw device or other means of moving the releasable shaft longitudinally.

In a preferred embodiment, the release device 8 is a depressible shaft which is axially aligned with the release shaft. The proximate end of the release shaft projects above the turret 22 a distance sufficient to move the releasable punch dampener from the engaged position to the released position when the release device is engaged. Positioned on the release device and proximate the release surface is a shoulder 12 which, when mounted acts to anchor the releasable punch dampener in the turret. In a preferred embodiment, the releasable shaft has an axis and is bilaterally symmetrical allowing longitudinal movement from the engaged position to the released position by activation of the release device.

On the release shaft is a release surface 10. In a preferred embodiment, the release surface is a narrowed portion of the release shaft and is a concave cutout surface approximately larger radius of curvature as the punch shaft so that in the released position, the punch does not touch the release surface. In a more preferred embodiment, the concave cutout is circumferential. Alternatively, the release surface 10 is a straight-edged cutout that provides an opening greater than the punch, so that when in the released position, the punch does not touch the release surface. Optionally, between the proximate end of the release shaft and the release surface is a shoulder 12. Adjacent to the release surface is a dampening surface 14. The dampening surface can be curved to engage the punch, or it can be angled. Preferably, the dampening surface is angled and is a transition from the release surface to the release shaft. The curved surface is effective in engaging the punch.

On the remote end 4 of the release shaft is a spring engaging surface 16 with a spring 18 mounted therein, such as a compression spring or a tension spring. Most preferably, the spring 18 is a compression spring. Preferably the engaging surface 16 is an opening 17 in the remote end 4 of the release shaft in which a spring is nested. Other tensioning devices can be used and positioned in other parts of the release shaft. In a preferred embodiment, the spring, in a relatively untensioned or uncompressed biased state, holds the releasable punch dampener in the engaged position. In the relatively untensioned or uncompressed biased position, the spring has some tension or compression applied to use the engaged dampener position to dampen the movement of the punch. In the released position greater tension or compression is applied to the spring using the release device 8.

In a preferred embodiment, the releasable punch dampener 100 is mounted in a dampener opening 20 in a rotary tableting press turret 22, wherein the opening peripherally intersects and is transverse to the lower punch guide 24, wherein the dampener opening has an opening proximate end 26 and an opening remote end 28, wherein the opening proximate end is at the exterior of the turret 30 and engages fixedly with a mounting device 32 such as a mounting screw. Preferably, the opening proximate end is threaded to engage with the mounting device 32. The releasable punch dampener release shaft 6 engages movingly through a longitudinal opening 34 in the mounting device and the release device 8 projects outward from the exterior of the turret 30. Preferably, the mounting device has a shoulder engaging surface 36 that engages with the shoulder 12 of the punch dampener, thereby holding the punch dampener in the dampener opening while allowing longitudinal motion of the releasable punch dampener. Preferably, at the remote end of the dampener opening, the spring of the mounted releasable punch dampener extends into a spring compression gap 38. Preferably, the compression gap is sufficiently large as to allow at least some of the spring, when the releasable punch dampener is released, to fit in the gap. Preferably, the spring is a compression spring with one end mounted on the spring engaging surface and the other end mounted on the opening remote end.

When the releasable punch dampener is used, in the engaged and relatively untensioned or uncompressed state and the release device projects outward from the turret, the dampening surface intersects the punch and dampens its motion. In the released state and the release device is depressed, the spring is compressed, the dampening surface moves away from the punch shaft, and the release surface moves proximate the punch shaft, thereby releasing the punch from the dampening effect.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A rotary tablet press turret comprising:

a bottom punch guide mounted in the rotary tablet press turret;

a bottom punch coaxially mounted in the bottom punch guide that is cam-controlled and moves from a stroke to a return stroke and back;

a releasable bottom punch dampener for dampening the movement of the bottom punch mounted in the rotary tablet press turret and transverse to the bottom punch guide, the releasable bottom punch dampener comprising:

a linear release shaft;

wherein the linear release shaft has a proximate end and a remote end;

wherein on the proximate end is a release device to move the linear release shaft;

wherein on the linear release shaft is a release surface;

wherein adjacent to the release surface is a dampening surface;

wherein on the linear release shaft is a spring engaging surface with a spring mounted thereon;

wherein the spring is biased to engage the dampening surface with the bottom punch;

wherein when the dampening surface is engaged with the bottom punch, the bottom punch moves from the stroke to the return stroke and back along the bottom punch guide; and wherein when the dampening surface is engaged with the bottom punch, the motion of the bottom punch is dampened to prevent an overshoot of the stroke or return stroke movement.

2. The rotary tablet press turret of claim 1, wherein the releasable bottom punch dampener has an engaged position and a released position;

wherein in the engaged position the spring acts on the spring engaging surface to move the dampening surface to engage with and dampen the bottom punch; and wherein in the released position the release device is engaged causing the dampening surface to move from the bottom punch and the release surface is moved proximate but not touching the bottom punch.

3. The rotary tablet press turret of claim 2, wherein the release surface is a narrowed portion of the release shaft and is an concave cutout surface approximately larger radius of curvature as the punch shaft; and wherein in the released position, the bottom punch does not touch the release surface.

4. The rotary tablet press turret of claim 3, wherein the concave cutout is circumferential.

5. The rotary tablet press turret of claim 4, wherein the dampening surface is angled and is a transition from the release surface to the release shaft to engage the bottom punch.

6. The rotary tablet press turret of claim 5, wherein the spring engaging surface is in an opening in the remote end of the release shaft in which the spring is nested.

7. The rotary tablet press turret of claim 6, wherein on the releasable bottom punch dampener between the proximate end of the release shaft and the release surface is a releasable bottom punch shoulder.

8. The rotary tablet press turret of claim 7, wherein the releasable bottom punch dampener is mounted in a dampener opening in the rotary tablet press turret;

wherein the dampener opening peripherally intersects and is transverse to the bottom punch guide;

wherein the dampener opening has an opening proximate end and an opening remote end; wherein the opening proximate end is at the exterior of the turret and engages fixedly with a mounting device; and wherein the mounting device has a longitudinal opening and the release shaft is moveably engaged in the longitudinal opening.

9. The rotary tablet press turret of claim 8, wherein the mounting device has a shoulder engaging surface that engages with the releasable bottom punch dampener shoulder, thereby holding the releasable bottom punch dampener in the dampener opening while allowing longitudinal motion of the releasable bottom punch dampener.

10. The rotary tablet press turret of claim 9, wherein the spring is a compression spring with one end mounted on the spring engaging surface and the other end mounted on the dampener opening remote end.

11. The rotary tablet press turret of claim 10, wherein the linear release shaft has an axis and is bilaterally symmetrical.

12. A rotary tablet press turret comprising:

a bottom punch guide;

a bottom punch coaxially mounted in the bottom punch guide that is cam-controlled and moves from a stroke to a return stroke and back;

a releasable bottom punch dampener for dampening the movement of the bottom punch comprising:

a linear release shaft;

wherein the release shaft has a proximate end and a remote end;

wherein on the proximate end the release shaft has a release device that moves the linear release shaft;

wherein the linear release shaft has a release surface;

wherein the linear release shaft has a dampening surface;

wherein on the linear release shaft is a spring mounted on a spring engaging surface;

wherein the releasable bottom punch dampener has an engaged position and a released position;

wherein in the released position the release device is engaged causing the dampening surface to move away from the bottom punch and the release surface to be proximate but not touching the bottom punch;

wherein the spring is biased to engage the dampening surface with the bottom punch;

wherein when the dampening surface is engaged with the bottom punch, the bottom punch moves from the stroke to the return stroke and back along the bottom punch guide; and wherein when the dampening surface is engaged with the bottom punch, the motion of the bottom punch is dampened to prevent an overshoot of the stroke or return stroke movement.

13. The rotary tablet press turret of claim 12, wherein the release surface is a narrowed portion of the release shaft.

14. The rotary tablet press turret of claim 13, wherein the release surface is a concave cutout surface approximately larger radius of curvature as the bottom punch shaft.

15. The rotary tablet press turret of claim 14, wherein the concave cutout is circumferential.

16. The of claim 15, wherein the rotary tablet press turret dampening surface is curved and is a transition from the release surface to the release shaft to engage the bottom punch.

17. The rotary tablet press turret of claim 16, wherein the spring engaging surface is an opening in the remote end of the release shaft in which the spring is nested.

18. The rotary tablet press turret of claim 17, wherein on releasable bottom punch dampener between the proximate end of the release shaft and the release surface is a releasable bottom punch dampener shoulder.

19. A rotary tablet press turret for a bottom punch comprising:

a bottom punch guide mounted in the rotary tablet press turret;

a bottom punch coaxially mounted in the bottom punch guide that is cam-controlled and moves from a stroke to a return stroke and back;

a dampener opening in the rotary tablet press turret;

wherein the dampener opening peripherally intersects and is transverse to the bottom punch guide;

a releasable bottom punch dampener for dampening the movement of the bottom punch mounted in the dampener opening, the releasable bottom punch dampener comprising:

a linear release shaft;

wherein the release shaft has a proximate end and a remote end;

wherein on the proximate end the release shaft has a release device that moves the linear release shaft;

wherein the linear release shaft has a release surface;

wherein the linear release shaft has a dampening surface;

wherein on the linear release shaft is a spring mounted on a spring engaging surface;

wherein the releasable punch dampener has an engaged position and a released position;

wherein in the engaged position the spring acts on the spring engaging surface to cause the dampening surface to engage with and dampen the bottom punch;

wherein in the released position the release device is engaged causing the dampening surface to move away from the bottom punch and the release surface to be proximate but not touching the bottom punch;

wherein the spring is biased to the engaged position;

wherein the release surface is a concave cutout surface approximately larger radius of curvature as the bottom punch shaft;

wherein the concave cutout is circumferential;

wherein the dampening surface is curved;

wherein the spring engaging surface is an opening in the remote end of the release shaft in which the spring is nested;

wherein between the proximate end of the release shaft and the release surface is a shoulder;

wherein the dampener opening has an opening proximate end and an opening remote end; wherein the opening proximate end is at the exterior of the turret and engages fixedly with a mounting device;

wherein the mounting device has a longitudinal opening and the release shaft is moveably engaged in the longitudinal opening;

wherein the mounting device has a shoulder engaging surface that engages with the releasable bottom punch dampener shoulder, thereby holding the releasable bottom punch dampener in the dampener opening while allowing longitudinal motion of the releasable bottom punch dampener; and wherein the spring is a compression spring with one end mounted on the spring engaging surface and the other end mounted on the dampener opening remote end.

20. The rotary tablet press turret of claim 19, wherein the release device is a depressible shaft which is axially aligned with the linear release shaft.

* * * * *